United States Patent [19]

Meyers

[11] Patent Number: 4,795,056

[45] Date of Patent: Jan. 3, 1989

[54] MICROWAVE DISH COVER

[75] Inventor: Kenneth A. Meyers, Reedsburg, Wis.

[73] Assignee: Gerber Products Company, Fremont, Mich.

[21] Appl. No.: 175,475

[22] Filed: Mar. 31, 1988

[51] Int. Cl.[4] ..... B65D 41/16; B65D 41/18

[52] U.S. Cl. ..... 220/306; 220/281; 215/321; 150/55

[58] Field of Search ..... 220/306, 281; 215/321, 215/216; 150/55

[56] References Cited

U.S. PATENT DOCUMENTS

| | | | |
|---|---|---|---|
| 1,676,868 | 7/1928 | Peterson . | |
| 3,208,620 | 9/1965 | Herdering | 220/306 |
| 3,351,227 | 11/1967 | Collie | 220/306 |
| 3,448,888 | 6/1969 | Smith et al. | 220/306 |
| 3,484,016 | 12/1969 | Turner . | |
| 4,180,178 | 12/1979 | Turner . | |

*Primary Examiner*—George T. Hall

*Attorney, Agent, or Firm*—Townsend and Townsend

[57] ABSTRACT

A cover for closing an opening of a container which is easily removable from the container. The cover is elongated and has two opposite narrow ends and two opposite elongated ends. The cover is attached to the container by latching means positioned at the narrow ends. The container includes an outwardly extending lip positioned on the upper edge of the container. The cover includes a flange resting on the outwardly extending lip. The latching means includes an inwardly extending protrusion extending from a connecting portion of the latching means beneath the outwardly extending lip to lock the latching means to the container. The cover includes pressure points for deforming the cover in an elongated direction. Latching means are provided on the narrow ends and may be released by deforming the cover in an elongated direction.

19 Claims, 1 Drawing Sheet

MICROWAVE DISH COVER

BACKGROUND OF THE INVENTION

1. Field of the Invention

This invention relates to a cover for a container, particularly a microwave dish, designed to prevent small children from opening the container and to protect the contents from foreign particles and contamination.

At the same time as the cover prevents small children from opening the container and protects its contents. A cover for a microwave dish must provide for ventilation during heating. Typically, containers having releasable covers require two hands for opening. In addition, opening procedures often require multiple steps.

2. Description of the Prior Art

U.S. Pat. Nos. 1,676,868 and 3,484,016 both disclose a cover having a domed configuration that is affixed to the opening of a container. By depressing the central raised portion, ears positioned at diametrically opposed edges are spread to release the cover from the container. Upon release, the cover member does not quite clear the mouth of the container and must be then pushed aside. This describes the operation of both disclosures.

U.S. Pat. No. 4,180,178 discloses a cover having a hinged central portion whereby downward pressure disengages a seal such that the cover may then be removed.

In each of these devices, a downward pressure is applied to release the cover which must then be removed from the container.

SUMMARY OF THE INVENTION

The present invention is a closure device which may be releasably attached to a microwave dish container. The closure device includes an elongated cover having an upper flat disk, a depending skirt and a flange formed at the bottom of the skirt. The flange is perpendicular to the skirt, parallel to the flat disk, and extends around the entire periphery of the closure device. Latching means are disposed at opposite narrow ends of the flange. The container includes an upper outwardly extending lip which is parallel to the flange when the cover is positioned on the container. In this closed position, the flange rests on the outwardly extending lip, thereby supporting the cover. The latching means engages the outwardly extending lip and locks onto it with a snap fit connection. Ventilation holes are provided in the cover to allow for microwave heating of the contents of the container.

The cover is removed from the container by applying pressure at pressure points positioned on elongated side surfaces of the cover. This deforms the cover in a direction coincident with the elongated direction of the cover. Removal is a simple one-step process which may be effected using one hand.

Yet, a small child would be unable to open the closure device because it is locked onto the container and may be removed only by applying a force at the narrowly defined pressure points. A small child would normally not have sufficient strength to apply the force required. In any event, such a child would not likely determine the required location to apply the required force.

DETAILED DESCRIPTION OF THE PREFERRED EMBODIMENT

Figure 1:
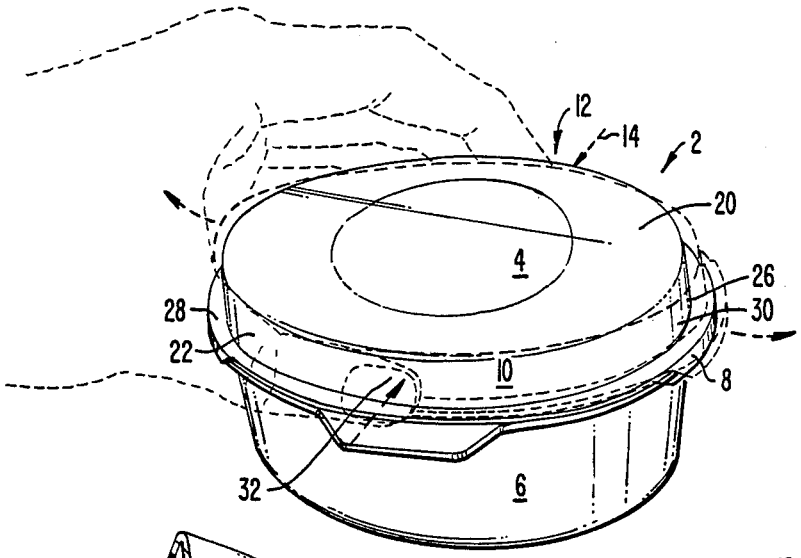
FIG. 1 is a perspective view of the present invention in which the cover is positioned on the container.
Figure 2:
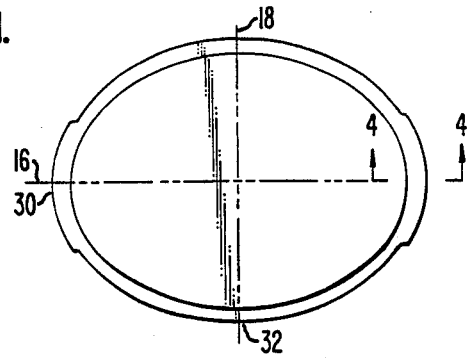
FIG. 2 is a top view of the cover.
Figure 3:
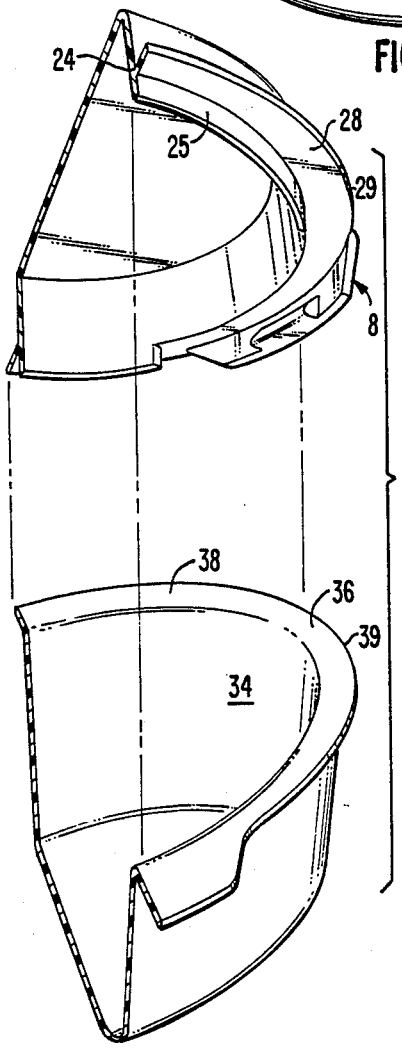
FIG. 3 is an exploded perspective view of the container and cover.
Figure 4:
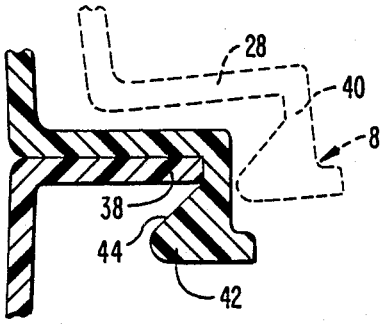
FIG. 4 is a cross-sectional view taken along arrow 4—4 while the cover is positioned on the container. The dotted lines of FIG. 4 illustrate the position of the cover as it is removed from the container.

Closure device 2 includes elongated cover 4 attached to container 6 by latching means 8. Elongated cover 4 includes vertically depending elongated side surfaces 10 having release means 12. Pressure is applied at pressure points 14 of release means 12 to disengage latching means 8.

Elongated cover 4 has an elliptical configuration and includes major axis 16 extending through the foci of the ellipse and minor axis 18 extending through the center of the ellipse and perpendicular to major axis 16. Narrow ends 30 are those portions of closure device 2 adjacent to a tangent of the ellipse which is parallel to minor axis 18. Elongated ends 32 are those portions of closure device 2 adjacent to a tangent of the ellipse which is parallel to major axis 16.

Cover 4 includes an upper flat disk 20 having the same general shape as cover 4. Skirt 22 depends from flat disk 20 generally in a perpendicular manner and is integral with flat disk 20. Skirt 22 extends around the entire perimeter of flat disk 20 so that flat disk 20 is spaced from container 6 when closure device 2 is positioned on container 6. Skirt 22 includes a lower edge 24 at the opposite edge of skirt 22 from flat disk 20. Skirt 22 includes two sets of diametrically opposed side surfaces including a first set of narrow side surfaces 26 positioned at narrow ends 30 and second set of elongated side surfaces 10 positioned at elongated ends 32. Flange 28 is formed integrally with skirt 22 at lower edge 24. Flange 28 is perpendicular to skirt 22 and parallel to flat disk 20. Latching means 8 are attached to elongated cover 4 at narrow ends 30.

Container 6 includes opening 34 having an upper edge 36. Opening 34 has the same configuration as the upper portion of container 6 and is turned to form outwardly extending lip 38. Lip 38 supports flange 28 when cover 4 is positioned on container 6. Opening 34 has a configuration identical to the lower edge 24 of skirt 22. Aligning means 25 are formed on cover 4 extending below flange 28 at least along a portion of skirt 22. Aligning means 25 fits within opening 34 adjacent to upper edge 36 to properly position cover 4 on container 6. In this position, outer edge 29 of flange 28 is aligned with outer edge 39 of outwardly extending lip 38.

Latching means 8 is constructed integrally with lower edge 29 of cover 4 and is located at narrow ends 30. Latching means 8 includes connecting portion 40 integrally formed with flange 28. Connecting portion 40 extends perpendicularly to flange 28 and disk 20 and parallel to skirt 22 and aligning means 25. An inwardly extending protrusion 42 is formed with connecting portion 40 and engages a lower surface of outwardly extending lip 88. Protrusion 42 has a triangular configuration allowing for ease of removal of closure device 2 from container 6.

In operation, closure device 2 is locked in place on container 6, closing opening 34. Protrusion 42 is snap fit below outer edge 39. Outwardly extending lip 38 fits snugly against connecting portion 40 between the lower surface of flange 28 and resting above inwardly extending protrusion 42.

In order to remove closure device 2 from container 6, one applies pressure at pressure points 14 to deform cover 4 in an elongated direction. Cover 4 is bowed upwardly such that latching means 8 is released from container 6. An upper triangular side 44 of protrusion 42 slides along outwardly extending lip 38 until cover 4 is fully released from latching means 8.

Closure device 2 is constructed of a plastic material which deforms when squeezed at pressure points 14 and elastically returns to its normal configuration when pressure is removed. By applying pressure to pressure points 14 of elongated side surfaces 10 of cover 4 rather than to narrow side surfaces 26, less force is required to deform cover 4 in an elongated direction along major axis 16 than would be required to deform cover 4 along minor axis 18 if pressure points were, instead, on narrow side surfaces 26. Thus, it is particularly advantageous to attach latching means 8 at narrow ends 30 rather than at elongated ends 32.

Container 6 is constructed of a harder plastic material than cover 4 and does not deform under normal pressure. Both materials are suitable for use in microwave ovens. The contents of container 6 must not be completely sealed if they are to be heated by microwave. Thus, ventilation holes, not shown, are provided in cover 4 for this purpose. For convenience, both materials are dishwasher safe.

This invention has been described with reference to the preferred embodiment. Variations and modifications can be made without departing from the scope of the present invention. For example, the preferred shape of the cover is an ellipse; however, it is within the scope of this invention to provide a cover in any elongated shape. The container need not be for use in a microwave oven, or the protrusion may have a cross-section other than triangular.

I claim:

1. A closure device for a container including an elongated cover comprising:

a pair of narrow ends, a pair of elongated ends and latching means attached to said cover at each of said narrow ends;

said latching means being adapted to be received by said container for attaching said cover to said container; and a set of side surfaces formed at said elongated ends including pressure points whereby pressure applied to said pressure points releases said latching means.

2. The closure device as defined by claim 1 wherein said cover is deformable in an elongated direction when pressure is applied to said pressure points, thereby releasing said latching means.

3. The closure device as defined by claim 1 wherein said cover comprises a deformable elastic material.

4. The closure device as defined by claim 3 wherein said deformable material is plastic.

5. The closure device as defined by claim 1 wherein said elongated cover comprises an elliptical shape.

6. The closure device as defined by claim 1 wherein said latching means is adapted to engage an upper edge of said container when said cover is positioned on said container and wherein said cover is deformable in an elongated direction when pressure is applied to said pressure points thereby releasing said latching means.

7. The closure device as defined by claim 1 wherein said latching means comprises an inwardly extending protrusion adapted to engage said container.

8. A cover for a dish comprising:

a flat disk having an elliptical shape with a major axis and a minor axis:

a skirt depending from said flat disk, said skirt having a lower edge and two sets of diametrically opposed side surfaces including a first set of narrow side surfaces having a tangent parallel to said minor axis and a second set of elongated side surfaces having a tangent parallel to said major axis, said elongated side surfaces including pressure points:

releasable latching means positioned adjacent to said narrow side surfaces adapted to overlap said dish whereby said latching means is releasable by means of pressure applied to said pressure points.

9. The cover as defined by claim 8 further comprising a flange, said flange attached to said skirt at said lower edge, said flange extending in a direction perpendicular to said skirt and parallel to said flat disk.

10. The cover as defined by claim 9 wherein said flange is adapted to engage an upper edge of said dish.

11. The cover as defined by claim 9 wherein said cover comprises aligning means extending parallel from said skirt at least along a portion of said side surfaces and adapted to extend into said dish when said cover is positioned on and closes said dish.

12. A dish including a container having an opening and an upper edge and a deformable cover for closing said opening said cover comprising:

a flat disk having an elliptical shape with a major axis and a minor axis;

a skirt depending from said disk, said skirt having a lower edge and two sets of diametrically opposed side surfaces including a first set of narrow side surfaces having a tangent parallel to said minor axis and a second set of elongated side surfaces having a tangent parallel to said major axis;

latching means for engaging said upper edge of said container, said latching means positioned on said skirt at said narrow side surfaces: and release means positioned on said skirt for deforming said cover to release said latching means.

13. The dish as defined by claim 12 wherein said release means comprises pressure points positioned on said side surfaces, said release means being activated by applying pressure to said pressure points.

14. The dish as defined by claim 12 wherein said upper edge of said container comprises an outwardly extending lip.

15. The dish as defined by claim 14 wherein said cover comprises a flange for engaging said outwardly extending lip, said flange having an outer edge and being attached to said skirt at said lower edge of said skirt, said flange extending in a direction perpendicular to said skirt and parallel to said disk, said latching means being positioned on said flange at said outer edge, said latching means extending perpendicular to said flange and said disk and parallel to said skirt and further including an inwardly extending protrusion.

16. The dish as defined by claim 15 wherein said latching means includes a connecting portion and said outwardly extending lip engages said connecting portion between said flange and said protrusion.

17. The dish as defined by claim 16 wherein said protrusion comprises a cross-section triangular in shape.

18. The dish as defined by claim 12 wherein said disk, said skirt and said latching means are integral.

19. A closure device for a container including a cover comprising:

a flat disk having a periphery, a first axis, and a second axis, said first and second axes being perpendicular to each other and intersecting said periphery;

two sets of diametrically opposed ends, one set of ends positioned along each of said first and second axes at said periphery;

latching means attached to one set of ends and receivable by said container for attaching said cover to said container; and a set of side surfaces formed at the other set of ends including pressure points whereby pressure applied to said pressure points releases said latching means.

* * * * *